United States Patent [19]

Gates

[11] 4,239,158

[45] Dec. 16, 1980

[54] SPRAY HEAD EXTENSION FOR PRESSURE DISPENSERS

[75] Inventor: William H. Gates, Santa Ana, Calif.

[73] Assignees: George L. Moyles; Roy Shook, both of Fullerton, Calif. ; part interest to each

[21] Appl. No.: 32,400

[22] Filed: Apr. 23, 1979

[51] Int. Cl.[3] ..... B05B 7/24; B65D 83/14

[52] U.S. Cl. ..... 239/567; 118/710; 134/44; 141/392; 222/402.14; 239/573; 239/579; 251/293; 251/353

[58] Field of Search ..... 239/337, 548, 567, 569, 239/573, 579, 596, 600; 222/398, 402.13, 402.24, 559; 137/797; 251/293, 350, 353; 184/105 B, 105 R; 141/38, 89, 91, 92, 392; 134/44, 54; 118/710; 285/4, 302, 138

[56] References Cited

U.S. PATENT DOCUMENTS

| | | | |
|---|---|---|---|
| 3,186,645 | 6/1965 | Eberlein | 239/573 X |
| 3,240,430 | 3/1966 | Diamond | 239/579 X |
| 3,684,185 | 8/1972 | Milcos | 239/337 |

FOREIGN PATENT DOCUMENTS

| | | | |
|---|---|---|---|
| 114362 | 6/1945 | Sweden | 239/596 |

*Primary Examiner*—Andres Kashnikow
*Attorney, Agent, or Firm*—Raymond L. Madsen

[57] ABSTRACT

There is disclosed a spray head extension for a pressurized container comprising a rigid elongated member having a fluid passageway along the length thereof extending from one end to a location adjacent the other end thereof, the elongated member having at least one opening connected between the fluid passageway adjacent the other end and the exterior surface of the elongated member, the one end having a receptacle therein connected to the fluid passageway and adapted and constructed to receive and engage the valve stem of a pressurized container and to direct the pressurized contents of the container into the fluid conduit and out of the at least one passageway when the valve stem is displaced to open the valve, the elongated member displacing the valve stem by pressing the one end of the elongated member against the interior wall of a space into which the elongated member is inserted, allowing the pressurized contents of the container to flow through the rigid elongated member and out of the at least one passageway thereby dispensing the pressurized contents of the container into a space too small to accept the container.

6 Claims, 9 Drawing Figures

SPRAY HEAD EXTENSION FOR PRESSURE DISPENSERS

DISCLOSURE

The present invention relates to fluid dispensers and more particularly to spray head attachments for pressurized containers.

In the field of pressure dispensers, it has been the general practice to employ a depressible valve stem to release the pressurized contents from the container. Various types of spray heads, buttons and ejection attachments for actuating the depressible valve stem have been utilized. For example, there is a plural source heated fluid mixing head disclosed in U.S. Pat. No. 3,300,095; a two hole aerosol button of U.S. Pat. No. 3,628,733; a tiltable spray button described in U.S. Pat. No. 3,464,597; an aerosol dispenser for dispensing measured amounts set forth in U.S. Pat. No. 3,414,171; a spray head with rotatable selector discussed in U.S. Pat. No. 3,298,611; a pressure ejection attachment for pressure dispensers disclosed in U.S. Pat. No. 3,240,430; a mechanical break-up actuator for fluid dispensers described in U.S. Pat. No. 3,406,913; a dispensing device set forth in U.S. Pat. No. 3,504,862; an actuator button and dispensing nozzle for an aerosol valve discussed in U.S. Pat. No. 3,365,138; a metering means utilized with continuous flow valves disclosed in U.S. Pat. No. 3,246,809; and a valve and nozzle construction for aerosol whipped cream dispenser disclosed in U.S. Pat. No. 3,333,744. Although such devices have served the purpose, they have not proved entirely satisfactory under all conditions of service for the reason that considerable difficulty has been experienced in directing the pressurized contents of the containers through the various spray heads onto remote and inaccessible surfaces such as the interiors of sink garbage disposal units and the like which have openings too small to accept the pressurized containers and spray heads described in the above patents. Heretofore there has been no spray head design which will facilitate the entry into small spaces and direct the pressurized contents of a spray can into remote and inaccessible areas.

Those concerned with the development of sink garbage disposals have long recognized the need for a spray dispenser for disinfectants and deodorizers which will reach the inaccessible interior surfaces of the garbage disposal unit to destroy odrs, germs and bacteria that accumulate thereon. The present invention fulfills this need.

The general purpose of this invention is to provide a spray head extension for the pressurized container which embraces all the advantages of similarly employed spray heads and possesses none of the aforedescribed disadvantages. To attain this, the present invention contemplates a unique elongated member with a plurality of nozzles in a directive array whereby remote areas and surfaces normally inaccessible to a pressurized container and its valve mechanism may be reached by the contents of the pressurized dispenser.

An object of the present invention is the provision of a spray head which allows the pressurized contents of a container to be dispensed and directed to remote and inaccessible interior surfaces of a substantially enclosed volume.

Another object is to provide a spray head for a pressurized container which actuates the depressible valve stem of the container by pressing the spray head against the remote interior surface of a substantially enclosed space into which the spray head is inserted.

A further object of the invention is the provision of a spray head attachment for a pressurized container which has a receptacle for receiving and engaging an extension arm which contacts the remote interior surface of a substantially enclosed volume to release the pressurized contents into the volume from a point positioned away from the remote interior surface.

Still another object is to provide a spray reversing nozzle attachment for a pressurized container that directs the pressurized contents of the container in a multiplicity of directions which form an acute angle with the axis of the container and which have an axial component directed back toward the container.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1:
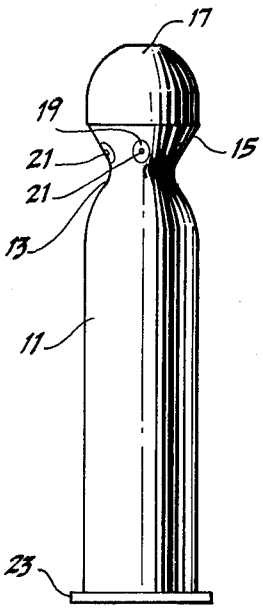
FIG. 1 illustrates a side elevation of a preferred embodiment of the invention.

Referring now to the drawings, wherein like reference characters designate like or corresponding parts throughout the several views, there is shown in FIG. 1 (which illustrates a preferred embodiment) a rigid elongated member 11 having a narrowed or neck portion 13 which widens out into a truncated conical surface 15 which in turn is connected to a rounded end or head portion 17. A plurality of nozzle inserts, each with an orifice 21 therein, are located around the truncated conical surface 15. At the end of elongated member 11 opposite head 17 is located a lip 23 around the circumference thereof.

Figure 2:
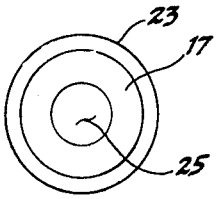
FIG. 2 shows a top view of the device shown in FIG. 1.

FIG. 2 is a top view of the device of FIG. 1 showing the head portion 17 with a receptacle 25 therein adapted and constructed to receive an extension arm (not illustrated).

Figure 3:
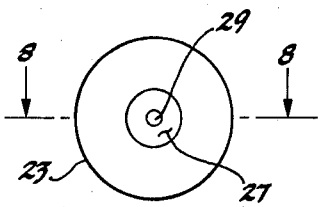
FIG. 3 shows a bottom view of the device illustrated in FIG. 1.

FIG. 3 illustrates the bottom view of the device illustrated in FIG. 1 showing a fluid conduit or passageway 29 which connects with orifices 21 of nozzles 19 (not illustrated). A socket or receptacle 27 is constructed and arranged to receive and fixedly engage a depressible valve stem of a pressurized container and to direct the pressurized contents of the container into fluid conduit 29.

Figure 4:
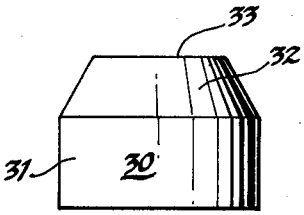
FIG. 4 shows a side elevation of an attachment collar which slidably engages the device of FIG. 1.

FIG. 4 shows a collar 30 which slidably engages the cylindrical section 11 of the device of FIG. 1. Collar 30 has a cylindrical section 31 and a truncated conical section 32.

Figure 5:
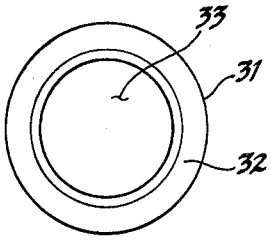
FIG. 5 shows a top view of the collar illustrated in FIG. 4.

FIG. 5 shows the top view of collar 30 of FIG. 4 and illustrates an opening 33 into which cylinder section 11 of the device of FIG. 1 is inserted into the top of conical section 32.

Figure 6:
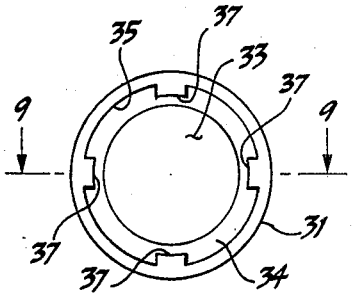
FIG. 6 shows a bottom view of the collar illustrated in FIG. 4.

FIG. 6 shows a bottom view of collar 30 of FIG. 4 wherein opening 33 is visible and the interior wall 35 of cylinder section 31 along with projections 37 from interior wall 35.

Figure 7:
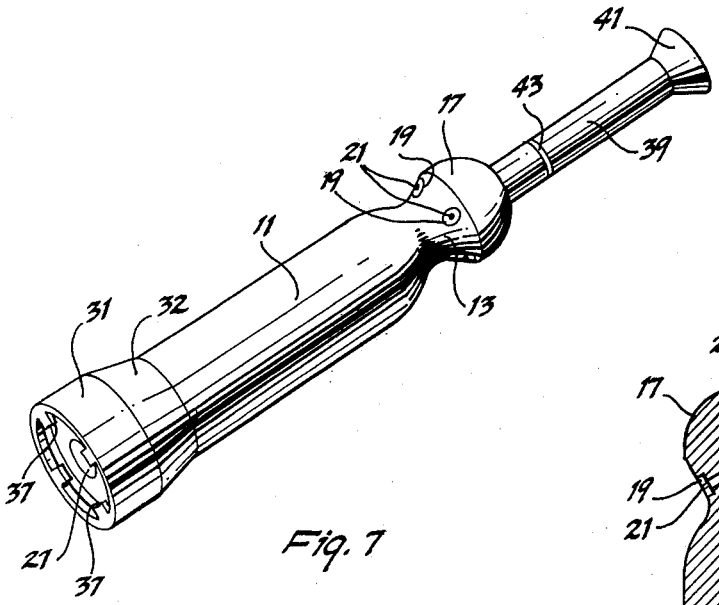
FIG. 7 illustrates a perspective view of the assembled devices shown in FIGS. 1 and 4 along with an extension arm.

FIG. 7 shows a perspective view of the device of FIG. 1 with collar 30 of FIG. 4 slidably engaged thereon and with an extension arm 39 engaged in socket 25 in head 17. Extension arm 39 has a foot or truncated conical section 41 at the end thereof opposite the end engaging head 17. A circumferential groove 43 is cut therearound to provide a break-away point to adjust the length of extension arm 39.

Figure 8:
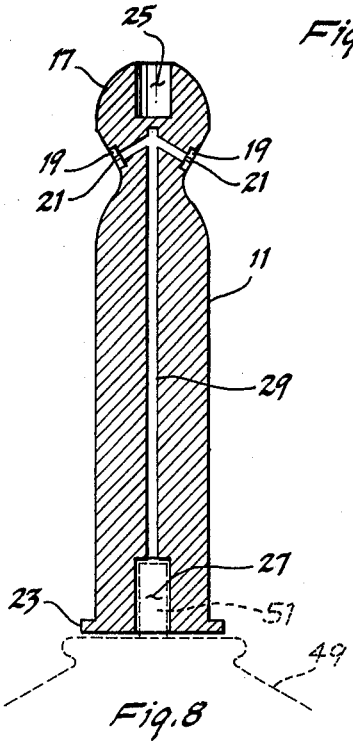
FIG. 8 shows a section of the device taken on the line 8—8 of FIG. 3 looking in the direction of the arrows.

FIG. 8 shows a cross-section view of the device illustrated in FIG. 3 taken on line 8—8 looking in the direction of the arrows. Receptacle 27 is shown receiving and engaging a depressible valve stem 51 shown in dashed lines of a pressurized container 49 also shown in dashed lines.

Figure 9:
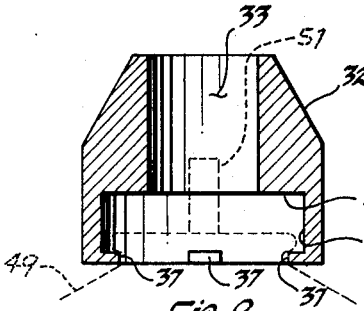
FIG. 9 illustrates a section of the collar device taken on line 9—9 of FIG. 6 looking in the direction of the arrows.

FIG. 9 illustrates collar 30 of FIG. 6 in cross-section taken on the line 9—9 looking in the direction of the arrows with radial projections 37 engaging the lip of pressurized container 49 shown in dash lines.

Operation of the invention can best be described by turning to FIG. 8. After elongated fluid conduit 11 is attached to valve stem 51, conduit 11 may be inserted into and through an opening which allows the diameter of fluid conduit 11 to pass therethrough but which will not allow the body of pressurized container 49 to pass. When head 17 strikes an interior surface of the space into which fluid conduit 11 is inserted, valve 51 of pressurized container 49 will be depressed releasing the pressurized contents of container 49 into a substantially straight and uniform passageway or fluid conduit 29 and out of orifices 21 of nozzles 19. Nozzles 19 are connected to tubular passageways which are angled back toward fluid conduit 29 forming an actue angle therewith so as to direct the pressurized fluid which sprays therefrom at a desired angle to reach hidden and inaccessible surfaces within the space into which elongated fluid conduit 11 is inserted. Therefore, if the pressurized contents of container 49 is a disinfectant and elongated fluid conduit 11 is inserted into the interior confines of a garbage disposal unit, the disinfectant spray released from nozzles 19 is directed to the upper surfaces of the interior of the garbage disposal unit to reach areas normally inaccessible to a pressurized spray can.

In order to position the location of nozzles 19 within the interior of a confined space, extension arm 39 of FIG. 7 may be inserted into socket 25 of FIG. 8 to locate nozzles 19 at a distance from an interior surface against which extension arm 39 is pressed. The length of extension arm 39 is adjusted by breaking it along a circumferential groove 43 to shorten the length thereof.

Other applications of the invention include the disinfecting of the under side of the rims of toilet bowls and spraying the interior of narrow necked containers and the like.

Collar 30 slides around elongated fluid conduit 11 to slidably hold and couple elongated fluid conduit 11 to the top of spray can or pressurized container 49. Lip 23 around the end of elongated fluid conduit 11 prevents elongated fluid conduit 11 from being pulled through opening 33 of collar 30 by engaging shoulder 34. When either head 17 or extension arm 39 engaged therein is pressed against a fixed surface, elongated fluid conduit 11 slides within opening 33 of collar 30 to displace or depress valve stem 51 engaged in socket 27 of elongated fluid conduit 11 to release the pressurized contents of pressurized container 49 into fluid passageway 29.

It now should be apparent that the present invention provides a spray head extension which may be employed in conjunction with pressurized containers for directing the pressurized contents of such containers into remote and inaccessible spaces.

Although particular components, etc. have been discussed in connection with a specific embodiment of a spray head extension constructed in accordance with the teachings of the present invention, others may be utilized. Furthermore, it will be understood that although an exemplary embodiment of the present invention has been disclosed and discussed, other applications and mechanical arrangements are possible, and that the embodiments disclosed may be subjected to various changes, modifications and substitutions without necessarily departing from the spirit of the invention.

What is claimed is:

1. An elongated fluid conduit closed at one end, the other end thereof having a socket constructed and arranged to receive and fixedly engage a depressible valve stem of a pressurized container, the valve stem communicating with said fluid conduit to release the contents of the pressurized container into said fluid conduit when the closed end of said fluid conduit is pressed against a fixed surface thereby depressing the valve stem, said fluid conduit having a plurality of tubular openings therethrough adjacent said closed end thereof for dispersing from said fluid conduit the contents of the pressurized container released thereinto, said plurality of tubular openings being angled outwardly and back toward said other end so as to disperse the contents of the pressurized container outwardly from said fluid conduit and backwardly toward said other end.

2. A spray head extension for a pressurized container, comprising:

A rigid elongated member having a substantially straight and uniform fluid passageway along the length thereof extending from one end to a location adjacent the other end thereof, said elongated member having at least one tubular opening through the walls thereof communicating between said fluid passageway at said location and the exterior surface of said elongated member adjacent said other end, said tubular opening intersecting said substantially straight and uniform fluid passageway to essentially form an acute angle therewith, said one end having a receptacle therein connected to said substantially straight and uniform fluid passageway, said receptacle being constructed and adapted to receive and engage the valve stem of a pressurized container and to direct the pressurized contents of the container into said substantially straight and uniform fluid passageway and out of said at least one tubular opening whereby the pressurized contents are directed at an acute angle with respect to said substantially straight and uniform fluid passageway when the valve stem is displaced to open the valve, said elongated member displacing the valve stem by pressing said one end of said elongated member against the interior wall of a space into which said elongated member is inserted, thereby enabling said elongated member to dispense the pressurized contents of the container outwardly and at an angle back toward the container into a space which will not accept the body of the pressurized container.

3. The spray head extension described in claim 2, further including a socket in said other end constructed and adapted to receive an extension arm for extending the length of said elongated member to reach the interior wall of a space into which it is inserted thereby locating said at least one tubular opening at a desired location within the space.

4. The spray head extension described in claim 3 further including an extension arm having one end which mates with and engages said socket and the other end for engaging the interior wall of a space into which said elongated member with said extension arm attached thereto are inserted.

5. The spray head extension described in claim 4 wherein said extension arm further includes at least one circumferential groove therearound at which groove said extension arm may be broken to adjust the length thereof.

6. The spray head extension described in claim 2 wherein said one end of said elongated member has a projecting lip around the perimeter thereof and further including a collar slidably attached to said elongated member, said collar having a cylindrical wall constructed and adapted to snap on the end of a pressurized container to slidably couple said elongated member to the container, said projecting lip preventing said elongated member from being disengaged from said collar and the pressurized container.

* * * * *